US012215960B2

(12) United States Patent
Peterson

(10) Patent No.: US 12,215,960 B2
(45) Date of Patent: Feb. 4, 2025

(54) BULLET FORMING PROCESS

(71) Applicant: Federal Cartridge Company, Anoka, MN (US)

(72) Inventor: Bryan P. Peterson, Isanti, MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

(21) Appl. No.: 18/373,250

(22) Filed: Sep. 26, 2023

(65) Prior Publication Data

US 2024/0102780 A1 Mar. 28, 2024

Related U.S. Application Data

(60) Provisional application No. 63/410,183, filed on Sep. 26, 2022.

(51) Int. Cl.

| | |
|---|---|
| ***F42B 33/00*** | (2006.01) |
| ***B21D 37/10*** | (2006.01) |
| ***F42B 12/06*** | (2006.01) |

(52) U.S. Cl.

CPC ..... *F42B 33/001* (2013.01); *B21D 37/10* (2013.01); *F42B 12/06* (2013.01)

(58) Field of Classification Search

CPC ..... F42B 12/00; F42B 12/04; F42B 12/06; F42B 12/08; F42B 12/74; F42B 12/76; F42B 12/78; F42B 33/00; F42B 33/001; B21D 37/10

USPC ..... 86/54, 55

See application file for complete search history.

(56) References Cited

U.S. PATENT DOCUMENTS

| | | | | |
|---|---|---|---|---|
| 2,379,701 | A * | 7/1945 | Friedman | B21K 1/025 86/54 |
| 3,782,287 | A * | 1/1974 | Sie | F42B 12/78 102/516 |
| 4,336,756 | A * | 6/1982 | Schreiber | F42B 12/78 102/516 |
| 5,131,123 | A * | 7/1992 | Brooks | F42B 12/34 86/54 |
| 5,943,749 | A * | 8/1999 | Swank | B21K 1/025 102/509 |
| 6,912,943 | B2 | 7/2005 | Bolhassani | |
| 7,406,906 | B1 | 8/2008 | Beal | |
| 7,637,193 | B1 | 12/2009 | Corder | |
| 8,141,467 | B1 | 3/2012 | Corder | |
| 9,329,009 | B1 | 5/2016 | Moore | |
| 9,360,284 | B1 | 6/2016 | Moore | |
| 9,733,052 | B2 | 8/2017 | Moore | |

(Continued)

FOREIGN PATENT DOCUMENTS

| | | | |
|---|---|---|---|
| EP | 1368612 | B1 | 7/2005 |
| WO | WO2014/125510 | A1 | 8/2014 |
| WO | WO2020/068937 | A1 | 4/2020 |

*Primary Examiner* — James S Bergin

(74) *Attorney, Agent, or Firm* — Christensen, Fonder, Dardi & Herbert PLLC; Timothy J. Busse

(57) ABSTRACT

Devices and methods for forming and assembling a bullet in a multi-stage press. In some embodiments, a forward component is radially oversized and forces a jacket outward during a press-fitting stage. In embodiments, the bullet workpiece does not turn over between any stages. In embodiments, one or more stages provide a reduced-diameter stem along with a radial ledge in the die to support the bullet while minimizing potential disturbances to a boat tail region from a punch.

20 Claims, 6 Drawing Sheets

(56) References Cited

U.S. PATENT DOCUMENTS

| | | | | |
|---|---|---|---|---|
| 10,076,781 | B1 | 9/2018 | Lee | |
| 10,900,759 | B2 | 1/2021 | Nichols | |
| 11,428,516 | B2 * | 8/2022 | Spanner | F42B 30/02 |
| 2015/0107481 | A1 * | 4/2015 | Nygaard | F42B 12/74<br>102/514 |
| 2018/0038673 | A1 | 2/2018 | Fridlund | |
| 2021/0341275 | A1 | 11/2021 | Robbins et al. | |
| 2024/0200918 | A1 * | 6/2024 | Gelfert | F42B 12/74 |

* cited by examiner

BULLET FORMING PROCESS

CROSS-REFERENCE TO RELATED APPLICATION

This disclosure is based on, and claims priority to, U.S. Provisional Application No. 63/410,183, filed on Sep. 26, 2022, the entire disclosure of which is incorporated by reference herein.

FIELD OF THE INVENTION

The present invention is directed to forming and assembling a bullet in a multi-stage press assembly.

BACKGROUND OF THE INVENTION

A multi-stage press forms and assembles source materials into a desired bullet shape. Conventional processes and assemblies are limited in dimensional and geometric accuracy due to, e.g., the limitations of tolerances between tool parts and workpieces, impact/press forces from a punch being transferred to unintended areas of the bullet, and the like.

SUMMARY OF THE INVENTION

In one general aspect, multi-stage process may include providing a multi-stage die assembly, each stage of the assembly having: a stationary die having a die cavity extending from a first end to a second end and defining a cavity diameter, a punch configured to press into the first end of the die, and an eject stem defining a stem diameter, the eject stem configured to extend into the second end of the die. The multi-stage process may also include in one or more preliminary stages: forming a rear component having: a core, a jacket having a cylindrical jacket body portion extending axially forward of the core, a tapering boat tail shape rearward of the jacket body portion, and a rear face defining a base diameter, the jacket body portion defining an inner jacket diameter and an outer jacket diameter, the outer jacket diameter being substantially equal to the predetermined caliber of the bullet. The process may furthermore include in a loose-fit stage: placing the rear component in the die with the rear face toward the second end of the die, and assembling the bullet by inserting a penetrator into the jacket via the punch applying a loose-fit force on the penetrator, the penetrator having: a base defining a penetrator diameter sized to press-fit relative to the inner jacket diameter, an ogive portion tapering in diameter from the base, and a forward tip. The process may in addition include in a press-fit stage: placing the bullet in the die with the rear face toward the second end of the die, seating the penetrator fully against the core via the punch applying a press-fit force to the penetrator, the press-fit force being greater than the loose-fit force, radially expanding the jacket in response to the press-fit force, the expanded outer jacket diameter being greater than the predetermined caliber, and supporting an annulus of the rear face of the rear component against the die, the die of the press-fit stage having a ledge extending radially inwardly to engage the annulus of the rear face. The process may moreover include in a jacket-forming stage: placing the bullet in the die with the rear face toward the second end of the die, decreasing the outer jacket diameter via the punch applying a jacket-forming force, and pressing a forward portion of the jacket against the ogive portion of the penetrator, in one or more finishing stages: placing the bullet in the die with the rear face toward the second end of the die, and the punch applying force to one or more of: the forward tip of the penetrator, the ogive portion of the penetrator, and the forward portion of the jacket. The process may also include where, in the press-fit stage, the stem diameter is less than the stem diameter in at least one of the loose-fit stage and the jacket-forming stage. Other embodiments of this aspect include corresponding systems, apparatus, and systems.

In one general aspect, multi-stage die assembly may include three or more stages, each stage having: a stationary die having a die cavity extending from a first end to a second end and defining a cavity diameter, a punch configured to press into the first end of the die, and an eject stem defining a stem diameter, the eject stem configured to extend into the second end of the die. The multi-stage die assembly may also include individual stages of the three or more stages may include: a loose-fit stage having: the punch having a hollow ogive portion configured to engage a forward portion of a bullet workpiece, and the die having the die cavity being substantially cylindrical, the cavity diameter being substantially equal to the predetermined caliber. Assembly may furthermore include a press-fit stage having: the punch having a hollow ogive portion configured to engage a forward portion of a bullet workpiece, and the die having: the die cavity having a forward portion proximate the first end and being substantially cylindrical, a boat tail shape portion rearward of the forward portion, and a rear portion proximate the second end and being substantially cylindrical, a ledge extending radially inwardly from the boat tail shape portion of the die cavity to the rear portion of the die cavity, the ledge configured to engage an annulus of a rear face of a bullet workpiece, and the cavity diameter along the forward portion of the die cavity being greater than the predetermined caliber. Assembly may in addition include a jacket-forming stage having: the punch having a hollow ogive shape configured to engage a forward portion of a bullet workpiece, the die having the die cavity being substantially cylindrical, the cavity diameter being substantially equal to the predetermined caliber. Assembly may moreover include where the stem diameter of the press-fit stage is less than the stem diameter in at least one of the loose-fit stage and the jacket-forming stage. Other embodiments of this aspect include corresponding systems, apparatus, and systems.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1A:
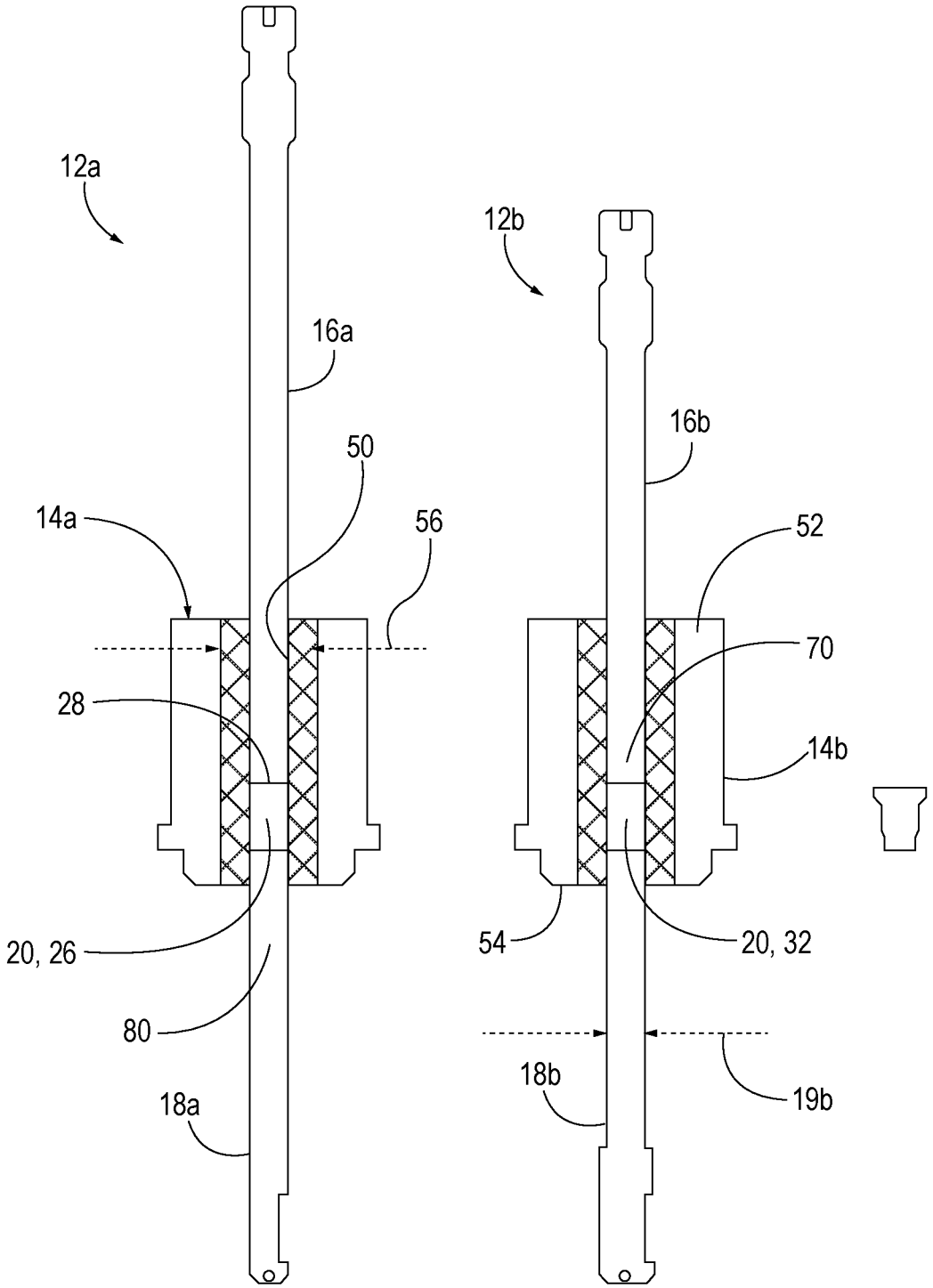
FIG. 1A is a cross-sectional view of an embodiment of isolated components of a multi-stage assembly in accordance with various embodiments disclosed herein.
Figure 1B:
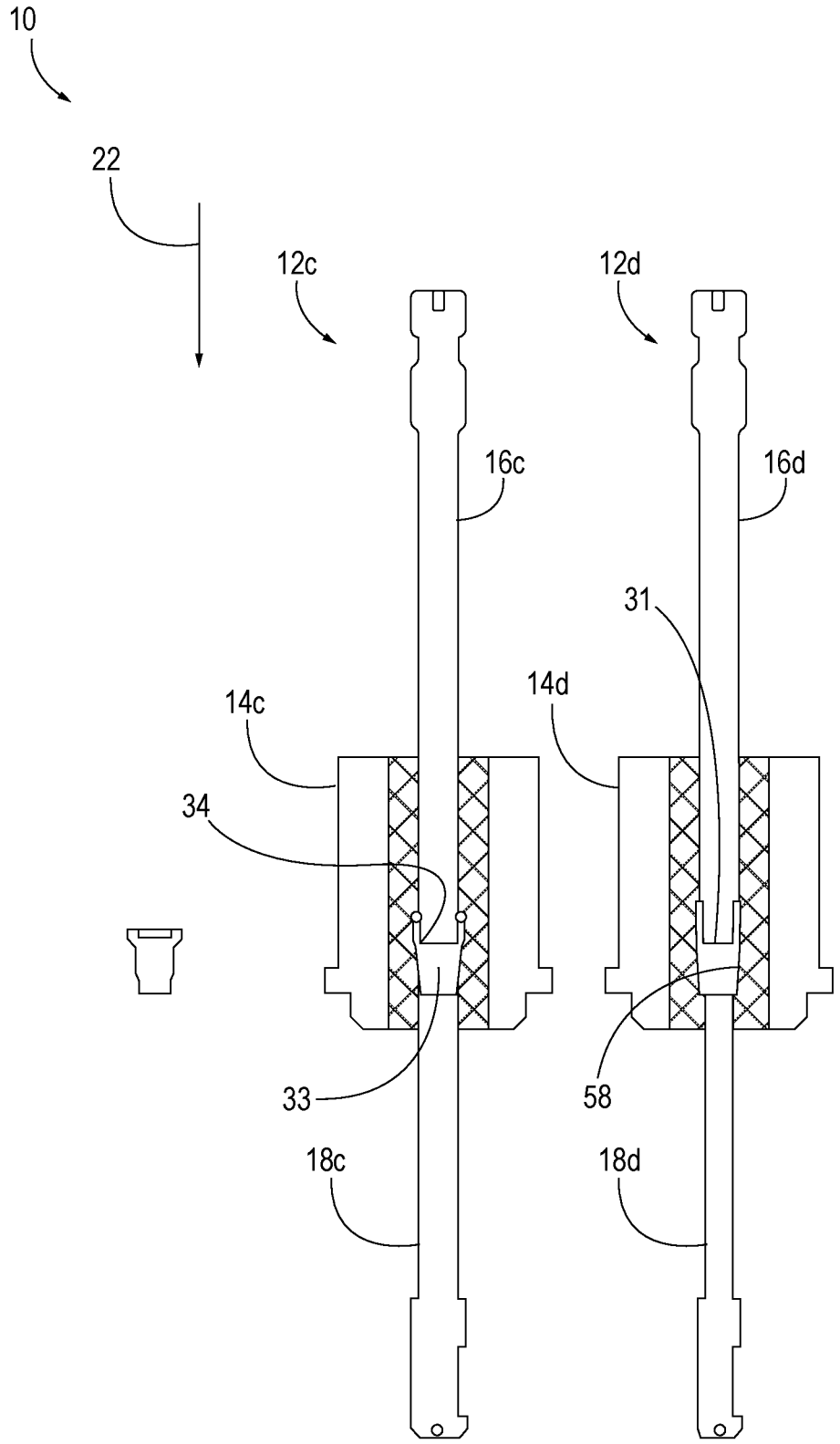
FIG. 1B is another cross-sectional view of an embodiment of isolated components of a multi-stage assembly in accordance with various embodiments disclosed herein.
Figure 1C:
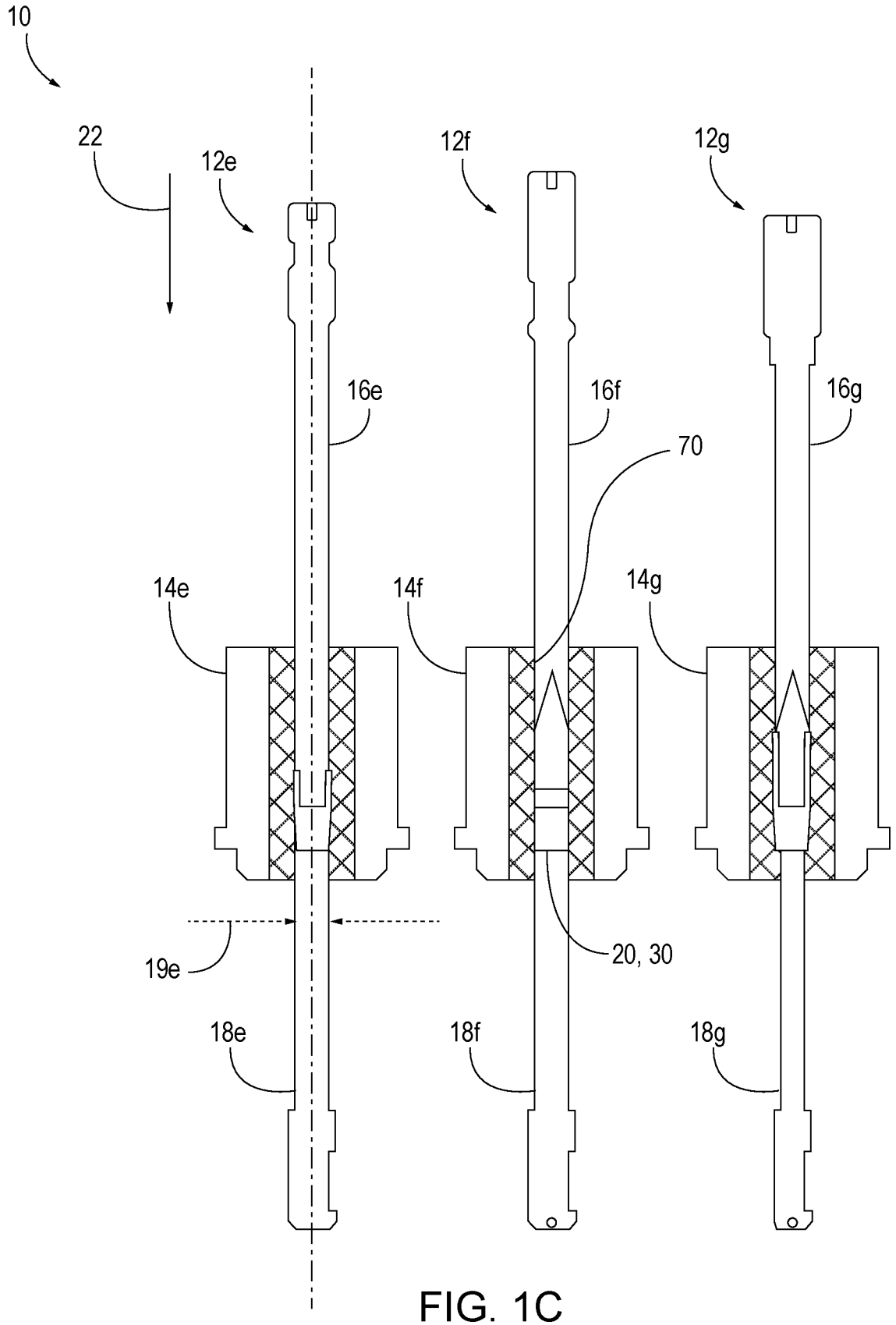
FIG. 1C is another cross-sectional view of an embodiment of isolated components of a multi-stage assembly in accordance with various embodiments disclosed herein.
Figure 1D:
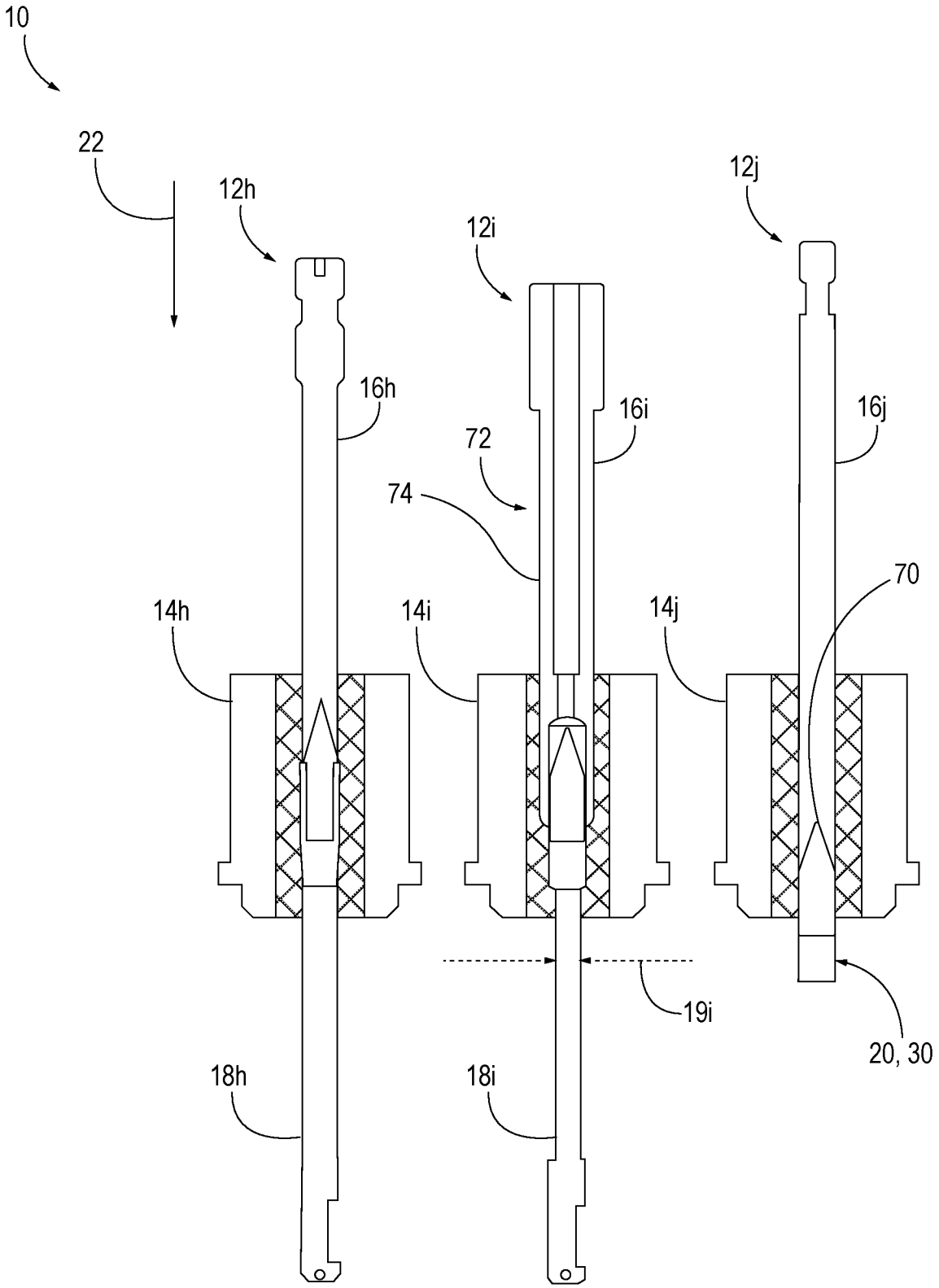
FIG. 1D is another cross-sectional view of an embodiment of isolated components of a multi-stage assembly in accordance with various embodiments disclosed herein.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

In the following detailed description of embodiments, reference is made to the accompanying drawings, which form a part hereof and in which are shown, by way of illustration, specific embodiments in which the invention may be practiced. Specific details disclosed herein are in every case a non-limiting embodiment representing concrete ways in which the concepts of the invention may be practiced. This serves to teach one skilled in the art to employ the present invention in virtually any appropriately detailed system, structure or manner consistent with those concepts. It will be seen that various changes and alternatives to the specific described embodiments and the details of those embodiments may be made within the scope of the invention. Because many varying and different embodiments may be made within the scope of the inventive concepts herein described and in the specific embodiments herein detailed without departing from the scope of the present invention, it is to be understood that the details herein are to be interpreted as illustrative and not as limiting.

The various directions such as "upper," "lower," "bottom," "top," "back," "front," "perpendicular", "vertical", "horizontal," "length" and width" and so forth used in the detailed description of embodiments are made only for easier explanation in conjunction with the drawings to express the concepts of the invention. The elements in embodiments may be oriented differently while performing the same function and accomplishing the same result as obtained with the embodiments herein detailed, and such terminologies are not to be understood as limiting the concepts which the embodiments exemplify.

As used herein, the use of the word "a" or "an" when used in conjunction with the term "including" (or the synonymous "may include" or "including") in the claims and/or the specification may mean "one," but it is also consistent with the meaning of "one or more," "at least one," and "one or more than one." In addition, as used herein, the phrase "connected to" means joined to or placed into communication with, either directly or through intermediate components.

Figure 2:
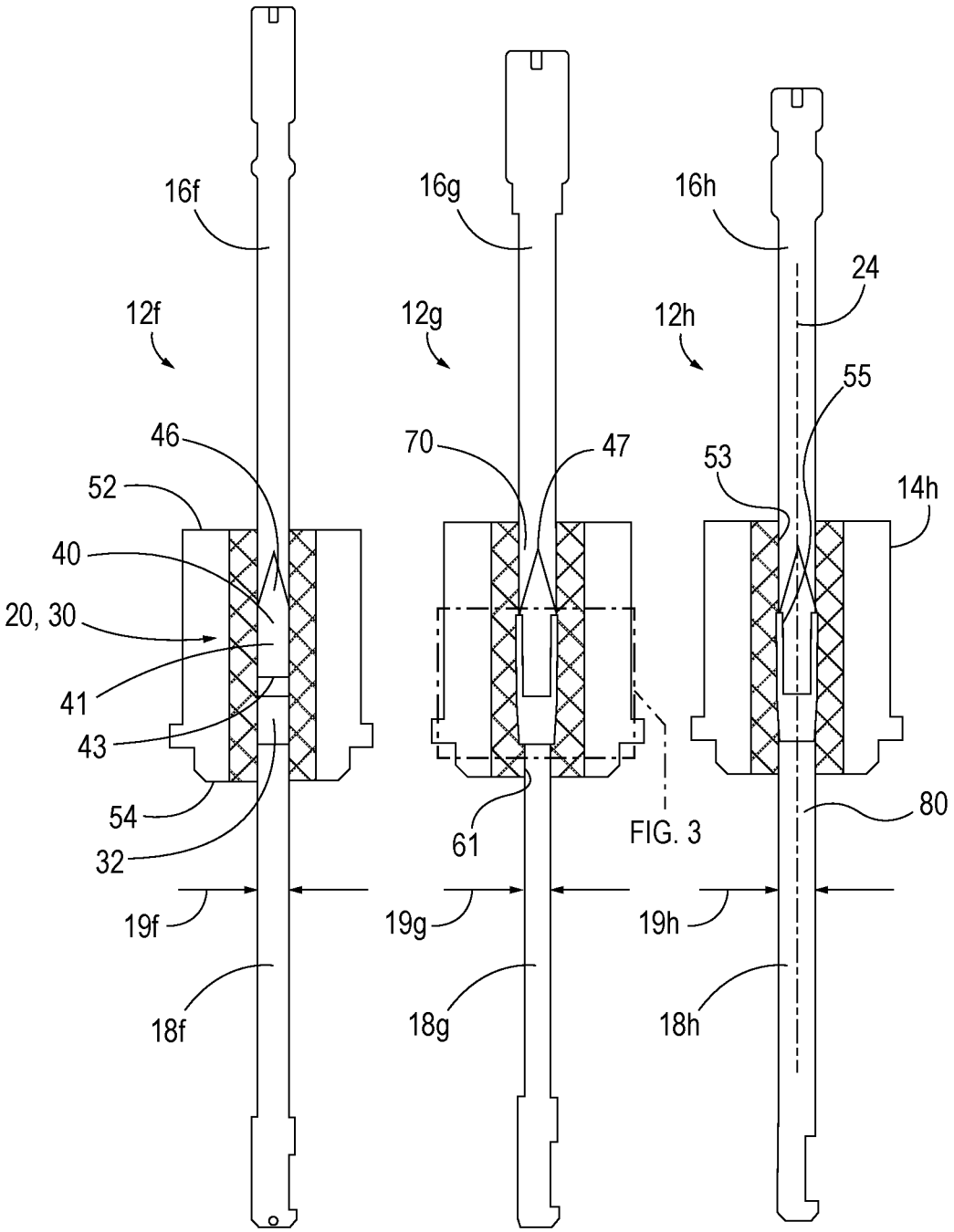
FIG. 2 is an enlarged view of an embodiment of three stages of the multi-stage assembly of FIGS. 1A-1D in accordance with various embodiments disclosed herein.

Referring to FIGS. 1 and 2, isolated components are illustrated of an embodiment of a multi-stage die assembly 10 for forming (e.g., swaging) and assembling a bullet over a plurality of stages 12A-J. The plurality of stages 12A-J are shown sequentially in FIG. 1 and may also be referred to as stations or steps. In embodiments, each of the plurality of stages 12A-J comprises a die 14A-J, a punch 16A-J, and a stem 18A-J, and each stage is configured to receive and work on a workpiece 20. The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

The multi-stage die assembly 10 in various embodiments is mounted in one or more machines or frames (not shown) and may include a transfer mechanism (not shown) such as transfer fingers for moving the workpiece 20 between stages 12A-J. Applicable examples and details of multi-stage die assemblies are disclosed in U.S. Pat. Nos. 2,379,701; 3,782,287; 5,131,123; 5,943,749; 7,406,906; 10,900,759; and 11,428,516 and U.S. Patent Application Publication No. 2015/0107481, the entire disclosures of which are incorporated herein by reference and for all purposes.

In certain embodiments, the dies 14A-J are stationary during operation. In embodiments, the punches 16A-J are powered for pressing in a punch direction 22 and along a longitudinal axis 24 into the respective die 14A-J to act on the workpiece 20 (e.g., apply a force to the workpiece). In embodiments, one or more of the punches 16A-J may include a backpressure mechanism provided by a gas spring or the like. In embodiments, the stems 18A-J are movable and configured to be stationary while the respective punch 16A-J presses on the workpiece 20. Each stem 18A-J comprises a stem diameter 19A-J for the portion of the stem that enters the respective die 14A-J to engage the workpiece 20.

In certain embodiments, as shown in FIG. 1, the workpiece 20 progresses from a blank 26 to a bullet 30. In some embodiments, blank 26 includes a piece cut from stock metal wire. In embodiments of preliminary stages such as any of stages 12A-12E, the punch 16A-E may work on a forward end 28 of the blank 26, forming a rear component 32.

In some embodiments, the rear component 32 comprises a core 33 and a jacket 34 that in certain embodiments are unitary, being integrally formed from one piece of material. In some embodiments, the metal includes copper, lead, tungsten, brass, steel, or other suitable material or material alloy, and combinations of any thereof. In some embodiments, the jacket 34 comprises a cylindrical jacket body portion 35 extending axially forward of the core 33, the jacket body portion having an inner surface 36, an outer surface 57, and terminating at a forward edge 66. In some embodiments, the core 33 of the rear component 32 comprises a front face 31 within the jacket 34 faces the forward end 28, and a rear face 38 defining a base diameter 39. In embodiments the rear face 38 is substantially planar and is also perpendicular or substantially perpendicular relative to the longitudinal axis 24. In certain embodiments, the rear component 32 comprises a boat tail region 59 tapering rearward and a corner or transition 63 from the boat tail region to the rear face 38.

In certain embodiments, the rear component 32 subsequently receives a forward component 40 within the jacket body portion 35 to assemble the bullet 30. In some embodiments, the forward component 40 comprises a base 41, a diameter 42 defined by the base, a rear face 43, and an outer surface 44 that may interface with at least a portion of the inner surface 36 of the jacket body portion 35. In embodiments, and as shown in exemplary embodiments in FIGS. 1-3, the forward component 40 is a penetrator comprising an ogive portion 46 tapering to a forward tip 47 and, in certain embodiments, comprises an annular recess 48 along the ogive portion. The annular recess 48 in some embodiments divides the ogive portion 46 into a forward ogive and a rear ogive which may have the same or different diameter and/or radii of curvature. In certain embodiments, the forward component 40 is formed of a harder material than typical lead or copper bullet cores, for example steel or tungsten carbide. As discussed below, in embodiments the diameter 42 is greater than the inner diameter 36D of the jacket 34 before forward component 40 is inserted, resulting in a press-fit assembly of the bullet 30 and radial expansion of the jacket 34.

Figure 3:
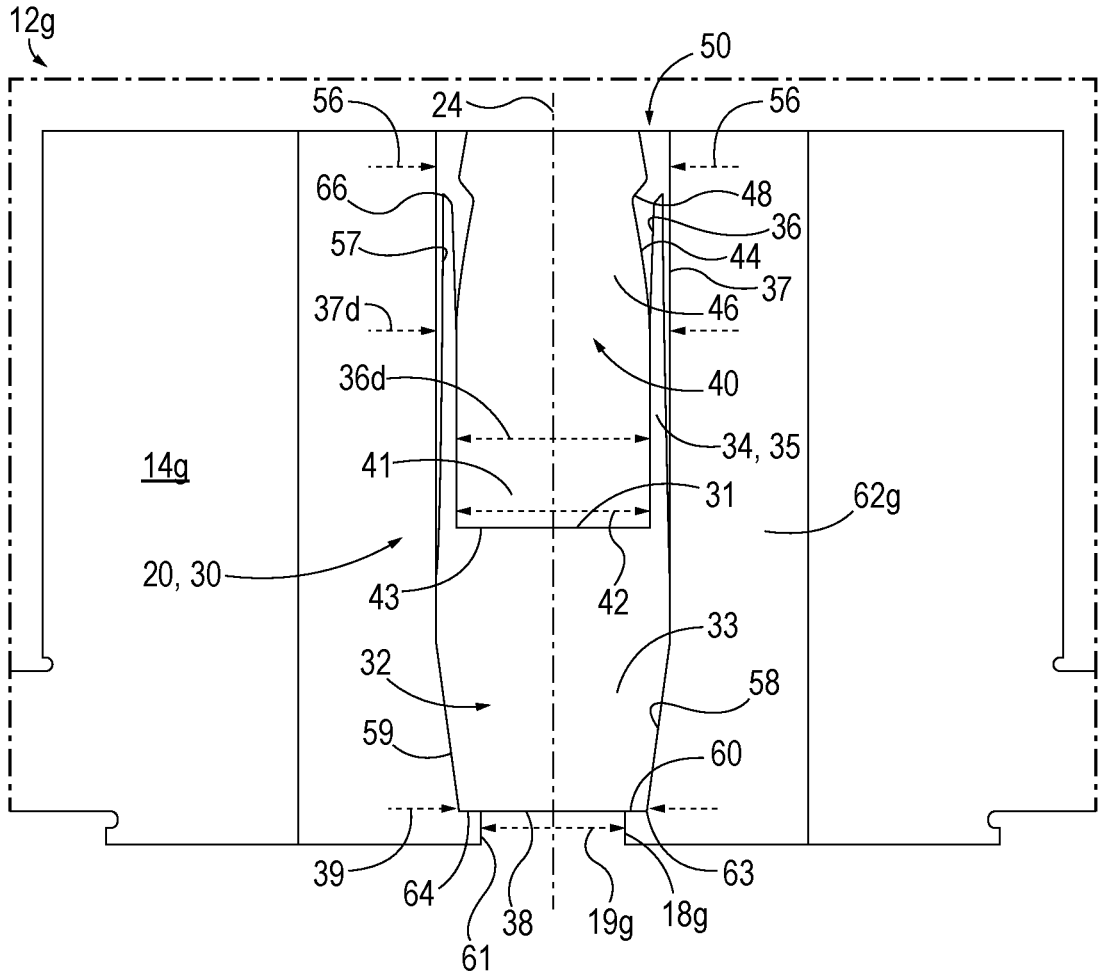
FIG. 3 is a partial enlarged view of an embodiment of one of the stages of FIG. 2 in accordance with various embodiments disclosed herein.

As shown in FIGS. 1-3, in embodiments, each die 14A-J comprises a die cavity 50 extending from a first end 52 to a second end 54 of the die. The first end 52 is oriented toward the respective punch 16A-J and the second end 54 is opposite the punch, and towards stem 18. The die cavity 50 defines a cavity diameter 56. In some embodiments, the cavity diameter 56 in one or more of the stages 12A-J is substantially equal to the intended and predetermined caliber of the bullet 30. In certain embodiments, the cavity diameter 56 in a press-fit stage 12G is greater than the intended and predetermined caliber of the bullet 30, and the cavity diameter 56 in the loose-fit stage 12F may also be greater than the predetermined caliber. In some embodiments, the die cavity 50 in one or more of the stages 12A-J is substantially cylindrical. In certain embodiments, the die cavity 50 in one or more of the stages 12A-J comprises a tapered diameter portion 58 for forming, defining and/or supporting a boat tail region 59 in the rear component 32. In certain embodiments, one or both of stages 12C, 12D comprise a boat tail forming stage with the respective punch 16C, 16D applying force to the forward end 28 of the rear component 32 to press the rear component into the tapered diameter portion 58 of the die 12C, 12D. In some embodiments, the die 14A-J in one or more stages 12A-J (e.g., a press-fit stage 12G as shown in FIG. 3) comprises a ledge 60 extending radially inward into the die cavity 50. In some embodiments, one or more of the dies 14A-J comprises a die insert 62A-J that defines the die cavity 50. The die insert 62A-J may be replaceable and may be formed of a different material than the rest of the die 14A-J.

In embodiments, each punch 16A-J is configured to reciprocate and be driven into the die cavity 50 at the first end 52 of the die. In some embodiments, each punch 16A-J comprises an end portion 70 that is shaped to engage the workpiece 20. In embodiments, the end portion 70 in stages 12B-12E has a reduced diameter relative to the cavity diameter 56 for forming and corresponding to the jacket 34 of the workpiece 20. In certain embodiments of later stages 12F-J, the end portion 70 is shaped to correspond and work on the forward component 40. In the illustrated embodiment, the end portion 70 of stages 12F-J is a hollow ogive shape. Accordingly, in those embodiments each punch 16A-J is configured to press and work on the front end 28 of the workpiece 20 (i.e., the front end 28 of the bullet 30). In other words, in embodiments the workpiece 20 is not turned over between stages, or in any stages, and the punches 16A-J do not directly impact or directly work on the rear face 38 or boat tail region 59 in any of stages 12A-J. In other words, the workpiece 20, or bullet 30, is always in the same orientation in stations 12A-J, with the forward end 28 or forward tip 47 of the bullet 30 facing up, or oriented towards the punch 16A-J, and the rearward end or tail facing down (i.e., both the rear face 38 of the rear component 32 and the rear face 43 of the forward component 40 facing down), or oriented towards the stem 18-A-J.

As shown in stage 12I of FIG. 1, in some embodiments, one or more stages 12A-J comprises a knock-out system 72 for separating the bullet 30 from the respective punch 16I. In certain embodiments, the knock-out system 72 includes a longitudinal slot 74 for a retractable pin (not shown) that selectively extends out of the end portion 70 to separate the bullet 30 from the respective punch 16I, for example, to overcome friction, stiction, and other forms of interference.

In embodiments, each stem 18A-J (also referred to as a rod or an eject stem) defines a stem diameter 19A-J at a terminal end 80 thereof. In embodiments each stem 18A-J is configured to be in a fixed stationary position while the respective punch 16A-J acts on the workpiece, and is configured to be movable in and out of die cavity 50 at the second end 54 of the die 14A-J. In embodiments, one or more of the stems 18A-J have a reduced stem diameter 19A-J as compared to the stems of other stages, for example one or more of the stems 18B, 18C, 18D, 18G, and 18I may have a reduced stem diameter 19. In certain embodiments, the stem diameter 19, for example 19G, in these stages is less than base diameter 39 of the bullet 30. In some embodiments, the stem diameter 19G is dimensioned from about 10%-95% of the base diameter 39, including embodiments of about 95%, about 90%, about 80%, about 70%, about 60%, about 50%, about 40%, about 30%, about 20%, about 10%, and ranges therebetween, including embodiments of about 20-95%, 20-40%, and 80-95%. In other embodiments, the maximum stem diameter 16G may be determined based on the desired base-to-boattail transition. Stated differently, the stem diameter 16G may be the width of the base diameter 39 minus the desired radius on the base-to-boattail transition, which may vary based on the desired predetermined caliber. In still other embodiments, the ledge diameter, or the amount of the base diameter 39 supported by the ledge 60, is approximately the balance of the base diameter that is not covered by the stem diameter 19. In certain embodiments, the ledge diameter is dimensioned from about 90%-5% of the base diameter 39, including embodiments of about 5%, about 10%, about 20%, about 30%, about 40%, about 50%, about 60%, about 70%, about 80%, about 90%, and ranges therebetween, and including embodiments of about 80%-5%, about 80%-60%, and about 20%-5%.

In embodiments, the stem diameter 19G is sized to separate the eject stem 18G from the transition 63 in the radial direction by a minimum radial distance at least 0.010, at least 0.020 inches, and ranges therebetween. In embodiments the transition 63 may be rounded in shape from the boat tail region 59 to the rear face 38, in this case the minimum distance to the eject stem does not include any rounded portion, i.e., the minimum distance is measured only along the relatively flat rear face 38.

In some embodiments, a smaller stem diameter 16G and corresponding ledge 60 may be used ensure the precision-made forming die controls every aspect of the projectile runout, concentricity, radii, etc. at the base of the bullet. In embodiments, the stem diameter 19G is at least about 0.075", and in other embodiments at least 0.090". In certain embodiments, the stem diameter 19 is about 0.187". In other embodiments, the stem diameter is from about 0.075" to about 0.20." In other embodiments, the stem diameter 19 is from about 0.09 to about 0.18, and ranges of any in between. In certain embodiments, the ledge 60 has a height of at least about 0.100". In other embodiments, the ledge 60 height is about 0.25". In still other embodiments, the ledge height is about 0.100" to about 0.35", or about 0.200" to about 0.25". In other embodiments, the shelf radius, or the radius distance of the shelf covering the rear face 38 is about 0.0303". In other embodiments, the shelf radius is at least about 0.01", at least about 0.02", at least about 0.04", at least about 0.05", at least about 0.06", at least about 0.07", at least about 0.08", at least about 0.09", at least about 0.1", at least about 0.25", and ranges of any in between.

Additional benefits of using a smaller stem diameter 19G and corresponding ledge 60 may include, but are not limited to, the bullet having a substantially consistent base-to-boattail radius both within a single bullet, and form bullet to bullet. In other embodiments, each bullet includes a rear face 38 that is substantially flat. In other embodiments, each bullet includes a portion supported by ledge 60 that is substantially flat. In still other embodiments, each bullet includes a rear face 38 is substantially perpendicular to the longitudinal axis 24. In other embodiments, each bullet includes a boat tail 59 that is substantially concentric to the a core 33. In other embodiments, each die includes the stem/ledge interface being far enough in the interior of the rear face of the bullet thereby allowing airflow that has followed the boattail to be stripped off of the bullet before it hits the relatively sharp transition (caused by the stem/ledge interface) to the base, and thus only interfaces with the portion of the base supported by the ledge 60 (i.e., the precision surfaces of the projectile only).

In some embodiments, it will be appreciated that the reduced stem diameter 19 is only present in a stage 12 that includes a die 14 having a ledge 60 in the die cavity 50. In one embodiment, it will be appreciated that the reduced stem diameter 19G in the press-fit stage 12G corresponds with the die 14G having the ledge 60 in the die cavity 50. As a result, during the pressing of the punch 16G in press-fit stage 12G with a relatively high press force, the stem 18G only interfaces with an inner portion of the rear face 38 of the rear component 32, thereby being spaced apart from the boat tail 59 and likewise spaced apart from the transition 63 (i.e. corner) between the boat tail 59 to the rear face 38. In some embodiments, the rear face 38 comprises an annulus 64 on a radially outer portion thereof that interfaces with the ledge 60 of the die 14G. In certain embodiments, due to being a monolithic, stationary, and high-strength part, the die 14G with ledge 60 and tapered portion 58 can better support, form, and maintain dimensional accuracy in the bullet than would otherwise be obtained by a combination of a die and full-diameter stem 18, i.e. stem 18 with the same diameter as the rear face 38 and/or the base diameter 39 or cavity diameter 56. In certain embodiments, the ledge 60 is sized such that the ledge 60 alone can support the bullet without a stem 18. Additionally, a portion of the pressing force of the punch 16G is counteracted by friction of the jacket outer surface 57 against the die cavity 50.

Embodiments of the present invention comprise a process or method of forming a bullet 30 of predetermined caliber in multiple stages through the use of the multi-stage die assembly 10. Embodiments of the process may be performed in a subset of the disclosed stages 12A-J, for example two, three, four, or more of the stages.

An example embodiment of the disclosed process includes providing the multi-stage die assembly 10, each stage of the assembly comprising: a stationary die 14A-J, a punch 16A-J configured to press into the first end of the die, and an eject stem 18A-J defining a stem diameter. The dies 14A-J comprise a die cavity 50 extending from a first end 52 to a second end 54 and defining a cavity diameter 56. The eject stem 18A-J is configured to extend into the second end 54 of the die 14A-J.

In the example embodiment, the process comprises stages as described below including: one or more preliminary stages 12A-E, a loose-fit stage 12F, a press-fit stage 12G, a jacket-forming stage 12H, and one or more finishing stages 12I-J.

In the example embodiment of the process, the one or more preliminary stages 12A-E comprise forming a rear component 32 comprising: a core 33, a jacket 34 comprising a cylindrical jacket body portion 35, a tapering boat tail shape 59 rearward of the jacket body portion, and a rear face 38 defining a base diameter 39. The cylindrical jacket body portion 35 extends axially forward of the core 33, the jacket body portion defining an inner jacket surface 36 and an outer jacket surface 57, the diameter of the outer jacket surface 57 being substantially equal to the predetermined caliber of the bullet 30. The rear component 32 comprises a boat tail shape region 59 with the base diameter 39 being less than the diameter at the outer jacket surface 57.

In the example embodiment of the process, the loose-fit stage 12G comprises placing the rear component 32 in the die 14G with the rear face 38 toward the second end 54 of the die. This stage also comprises assembling the bullet 30 by inserting a penetrator 40 into the jacket 34 via the punch 16F applying a loose-fit force on the penetrator. The penetrator 40 comprises a base 41 defining a penetrator diameter 42, a rear face 43, an ogive portion 46 tapering in diameter from the base 41, and a forward tip 47.

In the example embodiment of the process, the press-fit stage 12G comprises placing the bullet 30 in the die 14G with the rear face 38 toward the second end 54 of the die. This stage also comprises seating the penetrator 40 fully against the core 33, for example, the rear face 43 of the penetrator in contact with the forward face 31 of the core 33, via the punch 16G applying a press-fit force to the penetrator. In certain embodiments, the press-fit force is greater than the loose-fit force. This stage may also comprises radially expanding the jacket 34 in response to the press-fit force due to an oversized penetrator diameter 42 and/or more rigid material of the penetrator 40, for example steel, tungsten or tungsten carbide, compared to the jacket.

The resulting expanded outer jacket diameter 37D may then be greater than the predetermined caliber. This is possible because, as shown in FIG. 3, in some embodiments the die cavity 50 may be larger than the desired caliber, thereby creating a gap between the outer jacket surface 57 and the forward portion 37 of the die cavity. Thus, when a forward component 40, that has a diameter 42 that is larger than the inner diameter 36D of the jacket 34, is pressed into the die cavity 50, and thus the jacket, the jacket body portion is forced to expand taking the shape of the die and filling the gap(s) between the outer jacket surface 57 and the forward portion. In some embodiments, the gap may be from 0.001"-0.010" wide, including embodiments of about 0.009", about 0.008", about 0.007", about 0.006", about 0.005", about 0.006", about 0.005", about 0.004", about 0.003", and about 0.002". In certain embodiments, the gap may be from about 0.0005" to about 0.0050". In other embodiments, the gap may be about 0.0033".

This stage also comprises supporting an annulus 64 of the rear face 38 of the rear component 32 against the die 14G. The die 14G of the press-fit stage 12G comprises a ledge 60 extending radially inwardly to engage the annulus 64 of the rear face 38. At least one of the press-fit stage 12G and jacket-forming stage 12H serves to remove any potential air gaps between the penetrator 40 and the jacket 34 and to provide a strong retention force of the penetrator in the jacket. In certain embodiments of the resulting bullet, the bullet does not comprise any air gaps, or substantially any air gaps, between the penetrator 40 and the jacket 34. In embodiments, at completion of stage 12G, the bullet 30 diameter may be greater than the caliber diameter.

In the example embodiment of the process, the jacket-forming stage 12H, comprises placing the bullet 30 in the die 14H with the rear face 38 toward the second end 54 of the die. In embodiments, the die 14H provides a cavity diameter 56 in a forming portion 55 of the die that is equal to the predetermined caliber. In embodiments where bullet 30, or portions of bullet 30, have a diameter larger than the predetermined caliber, placing the bullet 30 into the die 14H presses radially inward on the bullet 30, reducing the outer jacket diameter 37D and smoothing any bulge or expansion from the preceding press-fit stage 12G. In embodiments, the die cavity 50 has a slight taper from the front end of the die 14H in a clearance portion 53 to accommodate the expanded outer jacket diameter 37D until the bullet 30 is fully inserted axially within the die, in other words, the forward tip 47 of the bullet 30 may not extend above the first end 52. Accordingly, the diameter of the cavity 50 at the clearance portion 53 is greater than the predetermined caliber, and greater than at forming portion 55, which may be equal to the predetermined caliber. Moreover, placing the bullet 30 in a smaller diameter die cavity 50 at the forming portion 55 induces significant friction forces acting against the punch direction 22, thereby distributing forces of the punch 16H during this jacket-forming stage 12H and mitigating stress concentration at the interface with the eject stem 18H. Consequently, in certain embodiments the ledge 60 and/or the tapering diameter 58 are omitted from this stage because there is not sufficient force to upset the geometry of the boat tail region 59, transition 63, and/or rear face 38 of the bullet. In other embodiments, during this stage, rear face 38 of the bullet may not contact eject stem 18H until eject stem 18H is needed to eject the bullet from die 14H.

In certain embodiments, the jacket-forming stage 12H may further comprise decreasing the outer jacket diameter 37D via the punch 16H applying a jacket-forming force upon the outer surface 57 of the jacket. This stage may also comprise pressing a forward portion 35 of the jacket 34 against the ogive portion 46 of the penetrator 40. In certain embodiments, this stage may also include pressing the forward edge 66 of the jacket 34 into the recess 48 of the penetrator. In certain embodiments, this may result in a substantially flush and continuous bullet surface, with the outer surface of the forward edge 66 forming a substantially continuous surface with the ogive portion 46 of the penetrator. In other embodiments, after jacket-forming stage 12H, there may be a gap between the forward edge 66 and a rearward facing face of recess 48. Such gap may vary from bullet to bullet, depending on how much jacket 34 is worked in jacket-forming stage 12H. During the jacket-forming stage 12H, material, for example, copper, brass, steel, or other suitable material or material alloy, of the jacket 34 is drawn around the penetrator 40, eliminating any gaps or voids between the two parts. In certain embodiments, the jacket thickness decreases as a result. In certain embodiments, jacket-forming stage 12H is possible because the penetrator 40 is made of a stronger material, for example, steel, tungsten, tungsten carbide, or other suitable material or material alloy. than the jacket 34, allowing the jacket 34 to be worked around the penetrator 40 without distorting penetrator 40.

More generally, embodiments of the jacket-forming stage 12H are distinct from conventional processes that may otherwise proceed from penetrator insertion directly to ogive formation. The jacket-forming stage 12H serves to draw the material of the jacket 34 around the penetrator 40 to remove all gaps and voids, and to otherwise increase the precision and accuracy of the forward portion of the jacket. The jacket-forming stage 12H may also result in lengthening and/or reduced thickness of the jacket 34 in some regions to better fit with the penetrator 40. In this manner, the jacket-forming stage 12H may work the jacket to compensate for any imperfections in the penetrator 40 geometry In other words, when manufacturing multiple bullets there may be some variability in dimensions such as jacket 34 thickness, the distance between forward edge 66 of the jacket and the annular recess 48, and the distance between the forward edge of the jacket and the forward tip 47 of the bullet, but the end result is that each bullet has an overall exterior bullet geometry that is more accurate to the intended bullet specifications.

Returning to the example embodiment of the process, the one or more finishing stages 12I-J comprise placing the bullet 30 in the die 14I-J with the rear face 38 toward the second end 54 of the die. This stage also comprises the punch 16I-J applying force to one or more of: the forward tip 47 of the penetrator 40, the ogive portion 46 of the penetrator, and the forward portion 35 of the jacket.

In one example embodiment, in the press-fit stage 12G, the stem diameter 19G is less than the stem diameter 19F, 19H in at least one of the loose-fit stage 12F and the jacket-forming stage 12H.

In embodiments, the penetrator diameter 42 is between about 0.0005"-0.0050" more than an inner diameter 36D of the jacket 34 to ensure a press fit. In certain embodiments, the penetrator diameter 42 may be about 0.0005"-0.0025", about 0.0005"-0.0030", about 0.0005"-0.0040, about 0.001"-0.005", about 0.001"-0.004", about 0.001"-0.003", or about 0.001"-0.002" more than an inner diameter 36D of the jacket 34, and ranges therebetween.

In embodiments, for every stage of the process, the rear face 38 is placed toward the second end 54 of the die 14A-J. This arrangement contributes to maintaining dimensional accuracy in the rear component 32, the boat tail region 59, and the rear face 38, such accuracy improving symmetry about the longitudinal axis 24, perpendicularity of the rear face 38 relative to the longitudinal axis, and consistency in the taper of the boat tail region 59.

In embodiments, in the loose-fit stage, the die cavity 50 is substantially cylindrical. In embodiments, in the loose-fit stage 12F, the die cavity 50 does not comprise a tapering diameter 58 corresponding to the boat tail shape 59 of the rear component 32. In embodiments, in the loose-fit stage 12F, the diameter 19F of the eject stem 18F is substantially equal to the cavity diameter 56 of the die 14F at the rear face 38 of the rear component 32. In embodiments, in the loose-fit stage 12F, the diameter 19F of the eject stem 18F is greater than the base diameter 39 of the rear face 38 of the rear component 32.

In embodiments, in the press-fit stage 12G, the cavity diameter 56 of the die 14G along the jacket body portion 35 is greater than in either the loose-fit stage 12F or the jacket-forming stage 12H. In embodiments, in the press-fit stage 12G, the die cavity 50 comprises a tapering diameter 58 corresponding to the boat tail shape 59 of the rear component 32.

In embodiments, the one or more finishing stages 12I-J comprise: in an ogive-refining stage 12I after the jacket-forming stage 12H: placing the bullet 30 in the die 14I with the rear face 38 toward the second end 54 of the die, and applying an ogive-refining force to one or more of: the forward tip 47 of the penetrator 40, the ogive portion 46 of the penetrator, and the forward portion 35 of the jacket 34. In embodiments, the ogive-refining force is greater than the jacket-forming force, and wherein, in the ogive-forming stage 12I, the stem diameter 19I is less than the stem diameter 19H in the jacket-forming stage 12H.

In embodiments, one or more of the loose-fit stage 12F, the press-fit stage 12G, and the jacket-forming stage 12H further comprise: ejecting the bullet 30 from the die 14F-H by inserting the eject stem 18F-H further toward the first end 52 of the die 50.

In embodiments, in a subsequent stage 12I-J after the jacket-forming stage 12H, ejecting the bullet 30 from the die 14I-J may be performed by retracting the eject stem 18I-J (for example, as shown in FIG. 1 for stage 12J with the eject stem 18J not visible).

In embodiments, the one or more preliminary stages 12A-E are performed in the multi-stage die assembly 10. In embodiments, each of the one or more preliminary stages 12A-E comprise placing the rear face 38 of the rear component 32 toward the second end 54 of the die 14A-E. In embodiments, the one or more preliminary stages 12A-E comprise: in a boat tail forming stage 12B-E: placing the rear component 32 in the die 14B-E with the rear face 38 toward the second end 54 of the die, wherein the die cavity 50 tapers in diameter toward the second end 54 of the die, and forming the boat tail shape 59 of the rear component 32 via the punch 16B-E applying a boat tail forming force to the rear component. Note that embodiments of the boat tail forming stage may be any one of the stages 12B-E, all stages 12B-E, or a subset of stages 12B-E.

In embodiments, for one or more stages 12A-J of the multi-stage die assembly 10, the die 14A-J comprises a die insert 62A-J defining the cavity diameter 56 of the die.

In embodiments, the jacket 34 and core 33 comprise a unitary component, for example, copper. In embodiments, the core 33 comprises a first core component and a second core component. In embodiments, the jacket 34 and the first core component comprise a unitary component. In embodiments, the core 33 may be formed of a material comprising lead and the jacket 34 may be formed of a material comprising copper. In embodiments, the jacket 34 surrounds the core 33 and defines the rear face 38 of the rear component 32.

Embodiments of the present disclosure provide a multi-stage die assembly 10 for forming a bullet 30 of a predetermined caliber. In one example assembly embodiment, the assembly 10 comprises three or more stages 12A-J. Each stage 12A-J comprises a stationary die 14A-J comprising a die cavity 50 extending from a first end 52 to a second end 54 and defining a cavity diameter 56, a punch 16A-J configured to press into the first end of the die, and an eject stem 18A-J defining a stem diameter 19A-J, the eject stem configured to extend into the second end of the die. Individual stages of the example assembly embodiment comprise a loose-fit stage, a press-fit stage, and a jacket-forming stage.

In the example assembly embodiment, the loose-fit stage 12F may comprise the punch 16F comprising a hollow ogive portion 58 configured to engage a forward portion of a bullet workpiece 30. The die 14F may comprise the die cavity 50 being substantially cylindrical and the cavity diameter 56 being substantially equal to the predetermined caliber.

In the example assembly embodiment, the press-fit stage 12G may comprise the punch 16G comprising a hollow ogive portion 58 configured to engage a forward portion of a bullet workpiece 30. The die 14G comprises the die cavity 50 comprising a forward portion 37 proximate the first end 52 and being substantially cylindrical, a boat tail shape portion 58 rearward of the forward portion, and a rear portion 61 proximate the second end 54 and being substantially cylindrical. A ledge 60 of the die 14G may extend radially inwardly from the boat tail shape portion 58 of the die cavity 50 to the rear portion 61 of the die cavity, the ledge 60 configured to engage an annulus 64 of a rear face 38 of a bullet workpiece 30. In embodiments, the cavity diameter 56 along the forward portion 37 of the die cavity 50 may be greater than the predetermined caliber.

In the example assembly embodiment, the jacket-forming stage 12H comprises the punch 16H comprising a hollow ogive shape 58 configured to engage a forward portion of a bullet workpiece 30. The die 14H comprises the die cavity 50 being substantially cylindrical, the cavity diameter 56 being substantially equal to the predetermined caliber. The stem diameter 19H of the press-fit stage 12 is less than the stem diameter 19F, 19G in at least one of the loose-fit stage 12F and the jacket-forming stage 12G.

In other embodiments of the disclosed process or assembly, the press-fit stage 12G may be modified to provide a penetrator diameter 42 that is substantially equal to the inner diameter 36D of the jacket 34, in other embodiments the penetrator diameter is equal to or greater than the inner diameter. In other embodiments of this or any other embodiment, the boat tail region 33 of the rear component 32 may be omitted (along with any corresponding tapered portion(s) 58 in the dies) to provide a bullet with a cylindrical rear, or a rear without a boat tail region 33.

Various modifications to the above examples are contemplated to be within the scope of the present disclosure. One skilled in the art will appreciate that additional stages may be added, certain stages may be duplicated, or certain stages may be omitted. In some embodiments, the rear component 32 is sourced or separately manufactured instead of being formed in the same die assembly 10. As discussed above, the forward component 40 in some embodiments is not a penetrator, generally the forward component 40 may be of any shape including non-ogive. Certain embodiments herein are addressed to match grade bullets that prioritize aerodynamic performance, bullets in accordance with military or law enforcement specifications, and the like. Embodiments of the disclosed bullets may be assembled in a cartridge sized from .17 caliber to .50 caliber, specific embodiments including a .224 Valkyrie and a 6.8 mm Rem SPC. In embodiments, the bullet 30 may have a core 33 that is lead, lead-free, multi-piece, or the like. The present disclosure may be applicable to various cartridges, as well as various types of firearms including handguns, rifles, semiautomatics, automatics, combinations thereof, and the like.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A multi-stage process of forming a bullet of a predetermined caliber, the process comprising:

providing a multi-stage die assembly, each stage of the assembly comprising: a stationary die comprising a die cavity extending from a first end to a second end and defining a cavity diameter, a punch configured to press into the first end of the die, and an eject stem defining a stem diameter, the eject stem configured to extend into the second end of the die;

in one or more preliminary stages:

forming a rear component comprising: a core, a jacket comprising a cylindrical jacket body portion extending axially forward of the core, a tapering boat tail shape rearward of the jacket body portion, and a rear face defining a base diameter, the jacket body portion defining an inner jacket diameter and an outer jacket diameter, the outer jacket diameter being substantially equal to the predetermined caliber of the bullet;

in a loose-fit stage:

placing the rear component in the die with the rear face toward the second end of the die, and assembling the bullet by inserting a penetrator into the jacket via the punch applying a loose-fit force on the penetrator, the penetrator comprising: a base defining a penetrator diameter sized to press-fit relative to the inner jacket diameter, an ogive portion tapering in diameter from the base, and a forward tip;

in a press-fit stage:

placing the bullet in the die with the rear face toward the second end of the die, seating the penetrator fully against the core by the punch applying a press-fit force to the penetrator, the press-fit force being greater than the loose-fit force, radially expanding the jacket in response to the press-fit force, the expanded outer jacket diameter being greater than the predetermined caliber, and supporting an annulus of the rear face of the rear component against the die, the die of the press-fit stage comprising a ledge extending radially inwardly to engage the annulus of the rear face; and in a jacket-forming stage:

placing the bullet in the die with the rear face toward the second end of the die, decreasing the outer jacket diameter via the punch applying a jacket-forming force, and pressing a forward portion of the jacket against the ogive portion of the penetrator, in one or more finishing stages:

placing the bullet in the die with the rear face toward the second end of the die, and the punch applying force to one or more of: the forward tip of the penetrator, the ogive portion of the penetrator, and the forward portion of the jacket, wherein, in the press-fit stage, the stem diameter is less than the stem diameter in at least one of the loose-fit stage and the jacket-forming stage.

2. The multi-stage process of claim 1, the penetrator diameter being between about 0.001"-0.002" more than the inner diameter of the jacket.

3. The multi-stage process of claim 1, wherein, for every stage of the process, the rear face is placed toward the second end of the die.

4. The multi-stage process of claim 1, wherein, in the loose-fit stage, the die cavity comprises a characteristic selected from at least one of: being substantially cylindrical or not comprising a tapering diameter corresponding to the boat tail shape of the rear component.

5. The multi-stage process of claim 1, wherein, in the loose-fit stage, the diameter of the eject stem is substantially equal to the cavity diameter of the die at the rear face of the rear component.

6. The multi-stage process of claim 1, wherein, in the loose-fit stage, the diameter of the eject stem is greater than the base diameter of the rear face of the rear component.

7. The multi-stage process of claim 1, wherein, in the press-fit stage, the cavity diameter of the die along the jacket body portion is greater than in either the loose-fit stage or the jacket-forming stage.

8. The multi-stage process of claim 1, wherein, in the press-fit stage, the die cavity comprises a tapering diameter corresponding to the boat tail shape of the rear component.

9. The multi-stage process of claim 1, the one or more finishing stages comprising: in an ogive-refining stage after the jacket-forming stage:

placing the bullet in the die with the rear face toward the second end of the die, and applying an ogive-refining force to one or more of: the forward tip of the penetrator, the ogive portion of the penetrator, and the forward portion of the jacket.

10. The multi-stage process of claim 9, wherein the ogive-refining force is greater than the jacket-forming force, and wherein, in the ogive-refining stage, the stem diameter is less than the stem diameter in the jacket-forming stage.

11. The multi-stage process of claim 1, wherein one or more of the loose-fit stage, the press-fit stage, and the jacket-forming stage further comprise:

ejecting the bullet from the die by inserting the eject stem further toward the first end of the die.

12. The multi-stage process of claim 1, further comprising: in a subsequent stage after the jacket-forming stage, ejecting the bullet from the die by retracting the eject stem.

13. The multi-stage process of claim 1, wherein the outer jacket diameter is decreased via the punch applying a jacket-forming force based on a predetermined caliber.

14. The multi-stage process of claim 13, wherein each of the one or more preliminary stages comprise:

placing the rear face of the rear component toward the second end of the die.

15. The multi-stage process of claim 13, the one or more preliminary stages comprising: in a boat tail forming stage:

placing the rear component in the die with the rear face toward the second end of the die, the die cavity tapering in diameter toward the second end of the die, and forming the boat tail shape of the rear component via the punch applying a boat tail forming force to the rear component.

16. The multi-stage process of claim 1, wherein for one or more stages of the multi-stage die assembly, the die comprises a die insert defining the cavity diameter of the die.

17. The multi-stage process of claim 1, wherein at least two of the first core component, the jacket, or core comprise a unitary copper component.

18. The multi-stage process of claim 1, wherein the core comprises a first core component and a second core component.

19. The multi-stage process of claim 1, wherein the core is formed of a material comprising lead and the jacket is formed of a material comprising copper, and wherein the jacket surrounds the core and defines the rear face of the rear component.

20. A multi-stage die assembly for forming a bullet of a predetermined caliber, the assembly comprising:

three or more stages, each stage comprising:

a stationary die comprising a die cavity extending from a first end to a second end and defining a cavity diameter, a punch configured to press into the first end of the die, and an eject stem defining a stem diameter, the eject stem configured to extend into the second end of the die;

individual stages of the three or more stages further comprising:

a loose-fit stage comprising:

the punch comprising a hollow ogive portion configured to engage a forward portion of a bullet workpiece, and the die comprising the die cavity being substantially cylindrical, the cavity diameter being substantially equal to the predetermined caliber, a press-fit stage comprising:

the punch comprising a hollow ogive portion configured to engage a forward portion of a bullet workpiece, and the die comprising:

the die cavity comprising a forward portion proximate the first end and being substantially cylindrical, a boat tail shape portion rearward of the forward portion, and a rear portion proximate the second end and being substantially cylindrical, a ledge extending radially inwardly from the boat tail shape portion of the die cavity to the rear portion of the die cavity, the ledge configured to engage an annulus of a rear face of a bullet workpiece, and the cavity diameter along the forward portion of the die cavity being greater than the predetermined caliber, and a jacket-forming stage comprising:

the punch comprising a hollow ogive shape configured to engage a forward portion of a bullet workpiece, the die comprising the die cavity being substantially cylindrical, the cavity diameter being substantially equal to the predetermined caliber, and wherein the stem diameter of the press-fit stage is less than the stem diameter in at least one of the loose-fit stage and the jacket-forming stage.

* * * * *